United States Patent [19]

Holt

[11] 4,205,435

[45] Jun. 3, 1980

[54] CONTACT INSERTION TOOL AND UNITARY CONTROL MECHANISM THEREFOR

[75] Inventor: Harley R. Holt, Forest Park, Ill.

[73] Assignee: Bunker Ramo Corporation, Oak Brook, Ill.

[21] Appl. No.: 894,971

[22] Filed: Apr. 10, 1978

[51] Int. Cl.[2] ..... H01R 43/00

[52] U.S. Cl. ..... 29/747; 29/235; 29/758; 74/2

[58] Field of Search ..... 29/747, 235, 755, 757, 29/758, 754; 74/2, 3.52

[56] References Cited

U.S. PATENT DOCUMENTS

| | | | |
|---|---|---|---|
| 2,530,938 | 11/1950 | Breuning | 74/2 X |
| 3,955,414 | 5/1976 | Anderson | 29/747 |

*Primary Examiner*—Carl E. Hall

*Attorney, Agent, or Firm*—F. M. Arbuckle; B. W. Sufrin

[57] ABSTRACT

A tool for facilitating the insertion of an electrical contact into a contact receiving bore of a resilient electrical connector together with a unitary control mechanism for such a tool. The tool has bore enlarging means including a sleeve and a rod coaxially aligned within the sleeve for insertion into the bore of the connector for enlargement thereof. The tool also includes a unitary control mechanism operatively associated therewith which enables relative movement between the sleeve and the rod. The unitary control mechanism includes spring release means which in a first position resists rearward movement of the sleeve and the rod, in a second position permits rearward movement of the rod but resists rearward movement of the sleeve, and again in the first position permits rearward movement of the sleeve for relative sequential movement between the sleeve and the rod. The tool can also include an opening therein having first and second pistons controlled by the unitary control mechanism with the sleeve being secured to the first piston and the rod being secured to the second piston. With such a tool, the unitary control mechanism enables the rod to be retracted within the sleeve for insertion of the contact into the sleeve and thereafter enables the sleeve to be withdrawn from the bore leaving the contact within the connector.

38 Claims, 4 Drawing Figures

CONTACT INSERTION TOOL AND UNITARY CONTROL MECHANISM THEREFOR

BACKGROUND OF THE INVENTION

The present invention relates to a contact insertion tool and, more particularly, a tool for facilitating the insertion of an electrical contact into a contact receiving bore of a resilient electrical connector and a unitary control mechanism for such a tool.

An electrical connector normally utilizes an insulator body in which the electrical contacts are mounted. The body is formed of a resilient material in some connectors with the contacts being mounted within bores extending through the body. In addition, the contacts are sometimes retained in the bores in the body by means of one or more internal diameter restrictions which extend radially inwardly from the wall of the bores to cooperatively engage a reduced diameter portion of the contacts. The insertion of contacts directly into the bores in the body sometimes causes damage to the internal diameter restrictions with insertion of the contacts being slow and difficult at best. Accordingly, the focus of those skilled in the art has been directed to development of a contact insertion tool capable of overcoming these problems in order to render fully effective resilient electrical connectors.

Some prior art devices for use in inserting electrical contacts into contact receiving bores in resilient electrical connectors essentially force the contacts into the bores. Such devices have not included means by which the bores can gradually be expanded, means for retracting a part of the opening means, and then means for removing the remainder of the opening means in a manner avoiding harm to the connector and permitting the bore to gradually return to its normal size and shape. Without these features, such prior art devices clearly do nothing to alleviate the possibility of damage to the internal diameter restrictions in the bores of a connector.

Other prior art devices for use in inserting electrical contacts into contact receiving bores in resilient electrical connectors do expand the bores prior to insertion of the contacts. Contacts are inserted in the expanded bores and the expansion apparatus is removed allowing the internal walls of the bores to contract and hold the contacts but these devices generally have not included means enabling quick insertion and removal of the expansion apparatus nor ready insertion of the contacts by application of near zero insertion forces. Additionally, such prior art devices have generally not included contact insertion tools which are hand operated and portable for use with resilient electrical connectors.

SUMMARY OF THE INVENTION

Accordingly, the present invention is directed in a broad sense to a tool for facilitating the insertion of an electrical contact into a contact receiving bore of a resilient electrical connector and a unitary control mechanism for such a tool. The tool has bore enlarging means including a sleeve and a rod coaxially aligned within the sleeve for insertion into the bore of the connector for enlargement thereof. The tool also includes a unitary control mechanism operatively associated therewith which enables relative movement between the sleeve and the rod. The unitary control mechanism, which is operable from a single location, includes spring release means which in a first position resists rearward movement of the sleeve and the rod, in a second position permits rearward movement of the rod but resists rearward movement of the sleeve, and again in the first position permits rearward movement of the sleeve for relative sequential movement between the sleeve and the rod. The tool can also include an opening therein having first and second pistons controlled by the unitary control mechanism with the sleeve being secured to the first piston and the rod being secured to the second piston. With such a tool, the unitary control mechanism enables the rod to be retracted within the sleeve for insertion of the contact into the sleeve and thereafter enables the sleeve to be withdrawn from the bore leaving the contact within the connector.

More specifically, the sleeve and the rod are each mounted for relative sliding movement between an extended position and a retracted position. The unitary control mechanism includes means for temporarily locking the sleeve and the rod in the extended position and the tool also includes means biasing the sleeve and the rod toward the retracted position when the sleeve and the rod are temporarily locked in the extended position. The rod and the sleeve may later be released for relative sequential movement from the extended position to the retracted position.

In a more detailed embodiment, the tool includes a housing having an opening extending therethrough with first and second pistons slidably mounted within the opening. The sleeve will then have a first end secured to the first piston and a second end extending beyond the housing with the sleeve being movable between first and second positions in response to sliding movement of the first piston within the opening. The rod will then also have a first end secured to the second piston and a second end extending beyond the housing with the rod being coaxially aligned within the sleeve and movable between first and second positions in response to sliding movement of the second piston within the opening. Of course, the sleeve and the rod are again adapted for insertion into the bore of the connector for enlargement thereof.

With this more specific embodiment, the unitary control mechanism is operatively associated with the first and second pistons enabling movement between the first and second pistons and, therefore, between the sleeve and the rod after the sleeve and the rod have been inserted into the bore of the connector for enlargement thereof. More particularly, the unitary control mechanism enables the second piston to move so as to cause the rod to move from the first position to the second position and thereafter enables the first piston to move so as to cause the sleeve to move from the first position to the second position. Preferably, the first position of the sleeve and the rod is an extended position and the second position of the sleeve and the rod is a retracted position.

Additional details of the more specific embodiment include the unitary control mechanism operable from a single location having means for temporarily locking the first and second pistons such that the sleeve and the rod are secured in the extended position. The temporary locking means preferably includes spring detent means cooperating with the first and second pistons and actuation means external of the housing for movement of the spring detent means between a first position and a second position. The tool also includes means biasing the first and second pistons such that the sleeve and the rod are biased toward the retracted position when the first and second pistons are temporarily locked with the spring detent means. The spring detent means preferably releases the second piston when the external actuation means is moved from the first to the second position and thereafter releases the first piston when the external actuation means is moved from the second back to the first position. Still additionally, the biasing means moves the second piston such that the rod moves from the extended position to the retracted position when the spring detent means releases the second piston and moves the first piston such that the sleeve moves from the extended position to the retracted position when the spring detent means releases the first piston.

In a still more specific embodiment, the tool is further characterized by the housing having a bore extending therethrough with the bore terminating at a forward end in an apertured front wall. The tool also includes first and second pistons slidably mounted within the bore in which the first piston has an opening extending therethrough and is positioned forwardly of the second piston and the second piston is mounted for independent sliding movement relative to the first piston. A sleeve is again provided having a first end secured to the first piston and having a second end extending through the apertured front wall of the housing to a point beyond the housing with the sleeve being movable between a first position in which the second end thereof is remote from the housing and a second position in which the second end thereof is near the housing in response to sliding movement of the first piston. A rod is again provided having a first end secured to the second piston and a second end extending through the wall in the first piston and the apertured front wall of the housing to a point beyond the housing with the rod being coaxially aligned within the sleeve and movable between a first position in which the second end thereof is remote from the housing and a second position in which the second end thereof is near the housing in response to sliding movement of the second piston. The tool further includes a unitary control mechanism operable from a single location operatively associated with the first and second pistons enabling relative sequential movement between the first and second pistons and, therefore, between the sleeve and the rod. With these features of construction, the unitary control mechanism includes spring release means which in a first position resists rearward movement of the first and second pistons, in a second position permits rearward movement of the second piston but resists rearward movement of the first piston, and again in a first position permits rearward movement of the first piston.

Once again, the first position of the sleeve and the rod is an extended position and the second position of the sleeve and the rod is a retracted position with the spring release means preferably including first and second spring detents for temporarily locking the first and second pistons such that the sleeve and the rod are secured in the extended position. The first and second spring detents are cooperatively associated with the first and second pistons and with actuation means external of the housing for movement of the first and second spring detents between the first position and the second position. When the external actuation means moves the first and second spring detents from the first to the second position, the second spring detent releases the second piston and the first spring detent thereafter releases the first piston when the external actuation means moves the first spring detent from the second position back to the first position.

Moreover, the tool will again include means biasing the first piston and the second piston rearwardly within the bore in the housing. The biasing means therefore will move the second piston such that the rod will move from the extended position to the retracted position when the second spring detent releases the second piston. Further, the biasing means will move the first piston such that the sleeve will move from the extended position to the retracted position when the first spring detent releases the first piston.

Still additional details include the external actuation means being integral with the first spring detent and the second spring detent being integral with one of the pistons with the second spring detent being adapted for axially aligned mating engagement in the first position with the first spring detent. The first piston preferably includes an elongated slot and the second piston includes a radial bore in communication with the elongated slot with the housing having an opening disposed relative to the elongated slot and the radial bore for axially aligned communication. The external actuation means and the first spring detent are disposed in the opening with the first spring detent being extensible into the elongated slot and the second spring detent is disposed in the radial bore and the elongated slot being extensible into the opening. The first and second spring detents each preferably include a projection and a notch with the projection of the first spring detent fitting into the notch of the second spring detent and the projection of the second spring detent fitting into the notch of the first spring detent when the first and second spring detents are in axially aligned mating engagement. With these features, the second spring detent will resist rearward movement of the first and second pistons when it is in axially aligned mating engagement with the first spring detent in the opening in the housing.

After the sleeve and the rod in the extended position have been inserted into the bore of the connector for enlargement thereof, the external actuation means can be used to move the first and second spring detents between the first and second positions. The second spring detent permits rearward movement of the second piston upon being moved into the elongated slot and the first spring detent resists rearward movement of the first piston upon being moved into the elongated slot with the first spring detent thereafter permitting rearward movement of the first piston upon being moved back into the opening in the housing. The external actuation means permits movement of the first and second spring detents from the opening in the housing into the elongated slot and thereafter permits movement of the first spring detent from the elongated slot back into the opening in the housing. The second spring detent can again be disposed in the opening in axially aligned mating engagement with the first spring detent by using means external of the housing for moving the first and second pistons such that the sleeve and the rod move from the retracted position to the extended position. Preferably, the piston moving means is an external piston extension of the second piston which may be moved forward causing the first and second pistons to move forward as well until the second spring detent and the first spring detent are again disposed in axially aligned mating engagement.

In its most general sense, the present invention is directed to a unitary control mechanism operable from a single location for a device such as a contact insertion tool having a pair of spring biased members slidably mounted therein. The mechanism includes first and second release means operatively associated with the pair of spring biased members. The first and second release means cooperate in a first position to prevent either of the spring biased members to slidably move within the device and the first release means is thereafter movable alone back to the first position permitting the other of the spring biased members to slidably move within the device. The mechanism also includes actuating means operatively associated with the first and second release means for moving them from the first position to the second position and thereafter moving the first release means from the second position back to the first position.

The present invention is therefore directed in its broadest sense to a unitary control mechanism operable from a single location for a device having a pair of spring biased members slidably mounted therein. It is directed more specifically to a tool for facilitating the insertion of an electrical contact into a contact receiving bore of a resilient electrical connector. This is accomplished by providing structure in which the control means is unitary and, preferably, bi-directional providing two stage operation with movement in a first direction permitting movement of one of a pair of members and movement in a second direction permitting movement of the other of the pair of members. The tool and unitary control mechanism of the present invention meet the objective of providing a device which quickly and easily permits the insertion of electrical contacts into the contact receiving bores in a resilient electrical connector with zero insertion force and without damage to the connector where the device can easily be made hand operated and portable as well. This is also accomplished with structure which is capable of low cost, light weight, but highly effective construction well suited for adaptability to a wide variety of applications. Still other objects and advantages of the present invention will be appreciated from a consideration of the details of construction and operation set forth in the accompanying specification, claims and drawings.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings. In the drawings, like reference numerals identify like elements in the several figures in which:

DETAILED DESCRIPTION OF THE PREFERRED EMBODIMENT

Figures 1, 2:
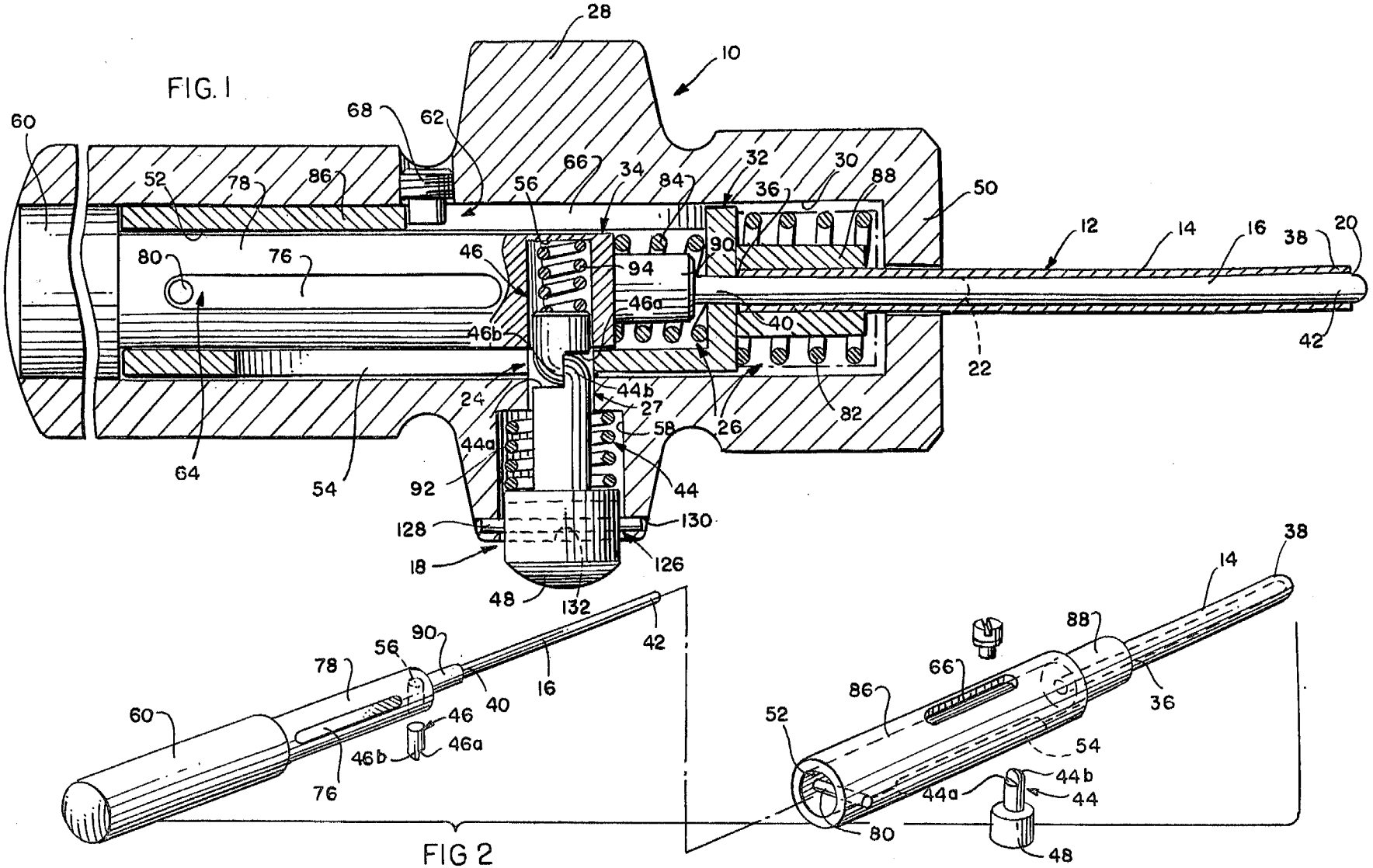
FIG. 1 is a cross-sectional view of a tool for facilitating the insertion of an electrical contact into a contact receiving bore of a resilient electrical connector in accordance with the present invention.
FIG. 2 is an exploded perspective view of the operative elements of the tool of FIG. 1.

In the illustration given and with reference first to FIG. 1, the numeral 10 designates generally a tool for facilitating the insertion of an electrical contact into a contact receiving bore of a resilient electrical connector. The tool 10 has bore enlarging means 12 including a sleeve 14 and a rod 16 coaxially aligned within the sleeve 14 for insertion into the bore of the connector for enlargement thereof. It also includes unitary control means 18 operatively associated with the sleeve 14 and the rod 16 enabling relative movement therebetween. The unitary control means 18 is referred to as "unitary" because it is operable from a single or "unitary" location. The unitary control means 18 enables the rod 16 to be retracted within the sleeve 14 and thereafter enables the sleeve 14 to be withdrawn from the bore of the connector after enlargement thereof. With these features of construction, the tool 10 is capable of quickly and easily inserting an electrical contact into a contact receiving bore of a resilient electrical connector without causing damage in the manner described hereinafter.

Referring to the tool 10 in greater detail, the sleeve 14 and the rod 16 are each mounted for relative sliding movement between a first or extended position (as at 20) and a second or retracted position (as at 22). The unitary control means 18 includes means 24 for temporarily locking the sleeve 14 and the rod 16 in the extended position 20 and the tool 10 further includes means 26 biasing the sleeve 14 and the rod 16 toward the retracted position 22 when the sleeve 14 and the rod 16 are temporarily locked in the extended position 20. The unitary control means 18 also includes means 27 for releasing the temporary locking means 24 for relative sequential movement of the rod 16 and the sleeve 14 from the extended position 20 to the retracted position 22.

The tool 10 also includes a housing 28 having an opening 30 extending therethrough with first and second pistons 32 and 34 slidably mounted within the opening 30. The sleeve 14 has a first end 36 secured to the first piston 32 and a second end 38 extending beyond the housing 28 with the end 38 of the sleeve 14 being movable between the extended position 20 and the retracted position 22 in response to sliding movement of the first piston 32 within the opening 30. The rod 16 also has a first end 40 secured to the second piston 34 and a second end 42 extending beyond the housing 28 with the rod 16 being coaxially aligned within the sleeve 14 and the end 42 thereof being movable between the extended position 20 and the retracted position 22 in response to sliding movement of the second piston 34 within the opening 30. The tool 10 further includes the unitary control means 18 being operatively associated with the first and second pistons 32 and 34 so as to enable movement between the first and second pistons 32 and 34 and, therefore, between the sleeve 14 and the rod 16.

More particularly, the temporary locking means 24 cooperates with the first and second pistons 32 and 34 such that the sleeve 14 and the rod 16 are secured in the extended position 20 against the force exerted by the biasing means 26 which tends to bias the rod 16 and the sleeve 14 toward the retracted position 22. The spring release means 27 later enables the second piston 34 to move so as to cause the rod 16 to move from the extended position 20 to the retracted position 22 and thereafter enables the first piston 32 to move so as to cause the sleeve 14 to move from the extended position 20 to the retracted position 22. Both the temporary locking means 24 and the spring release means 27 preferably utilize spring detent means 44 and 46 which cooperate with the first and second pistons 32 and 34 and actuation means 48 external of the housing 28 is provided for movement of the spring detent means 44 and 46 between a first or protruding position and a second or depressed position. The spring detent means 44 and 46 release the second piston 34 in the depressed position such that the rod 16 moves from the extended position 20 to the retracted position 22 and thereafter release the first piston 32 in the protruding position such that the sleeve 14 moves from the extended position 20 to the retracted position 22. Clearly, the external actuation means 48 can be utilized to move the spring detent means 44 and 46 from a protruding position to the depressed position and then back to the protruding position with the biasing means 26 causing the movement of the first and second pistons 32 and 34.

Referring still to FIG. 1, the opening 30 in the housing 28 is preferably a bore terminating at the forward end in an apertured front wall 50. The first and second pistons 32 and 34 are slidably mounted within the bore 30 with the first piston 32 having an opening 52 (as shown in FIG. 2) extending therethrough and being positioned forwardly of the second piston 34 (as shown in FIG. 1). The sleeve 14 extends through the apertured front wall 50 of the housing 28 to a point well beyond the housing 28 in the extended position 20 and the rod 16 extends through the opening 52 in the first piston 32 and the apertured front wall 50 of the housing 28 to a point well beyond the housing 28 in the extended position 20 as well. The unitary control means 18 operatively associated with the first and second pistons 32 and 34 enables relative sequential movement between the first and second pistons 32 and 34 and, therefore, between the sleeve 14 and the rod 16 in the manner described hereinabove.

The external actuation means or push button 48, which is shown in an intermediate position, is preferably integral with the first spring detent 44 and the second spring detent 46 is integral with the second piston 34. The first and second spring detents 44 and 46, which are depicted in an intermediate position in conjunction with push-button 48, are adapted for axially aligned mating engagement with each other because of the cooperative design features of the first piston 32, the second piston 34, and the housing 28. The first piston 32 includes an elongated slot 54, the second piston 34 includes a radial bore 56 in communication with the elongated slot 54 and the housing 28 has an opening 58 adapted for axially aligned communication with the elongated slot 54 and the radial bore 56. The push button 48 and the first spring detent 44 is extensible into the elongated slot 54 while the second spring detent 46 is disposed in the radial bore 56 and the elongated slot 54 and is extensible into the opening 58. The first and second spring detents 44 and 46 each preferably include a notch **44*a*, 46*a* and a projection 44*b*, 46*b* with the projections 44*b*, 46*b* being adapted to fit into corresponding ones of the notches 44*a*, 46*a*. As will be appreciated from FIG. 1, the second spring detent 46 resists rearward movement of the first and second pistons 32 and 34 when the projection 46*b* thereof extends into the opening 58 in the housing 28 to cooperate with the notch 44*a* for axially aligned mating engagement of the second spring detent 46 with the first spring detent 44**.

After the sleeve 14 and the rod 16 have been inserted into the bore of a connector for enlargement thereof, the push button 48 can be used to move the first and second spring detents 44 and 46 between the protruding and depressed positions. The second spring detent 46 permits rearward movement of the second piston 34 upon being moved out of the opening 58 and into the elongated slot 54 (as shown in FIG. 1 ) with the first spring detent 44 resisting rearward movement of the first piston 32 upon being moved into the elongated slot 54 but thereafter permitting rearward movement of the first piston 32 upon being moved out of the elongated slot 54 and back into the opening 58. Of course, the push button 48 permits movement of the first and second spring detents 44 and 46 from the opening 58 into the elongated slot 54 and thereafter permits movement of the first spring detent 44 from the elongated slot 54 back into the opening 58. The second spring detent 46 can again be disposed for axially aligned mating engagement by using means 60 external of the housing 28 for moving the first and second pistons 32 and 34 such that the sleeve 14 and the rod 16 move from the retracted position 22 back to the extended position 20. Preferably, the piston moving means 60 is simply an external piston extension of the second piston 34 which may be moved forward causing both the first and second pistons 32 and 34 to move until the projection **46*b* of the second spring detent 46 once again extends into the opening 58 in the housing 28 to cooperate with the notch 44*a* for axially aligned mating engagement of the second spring detent 46 with the first spring detent 44**.

Figure 3:
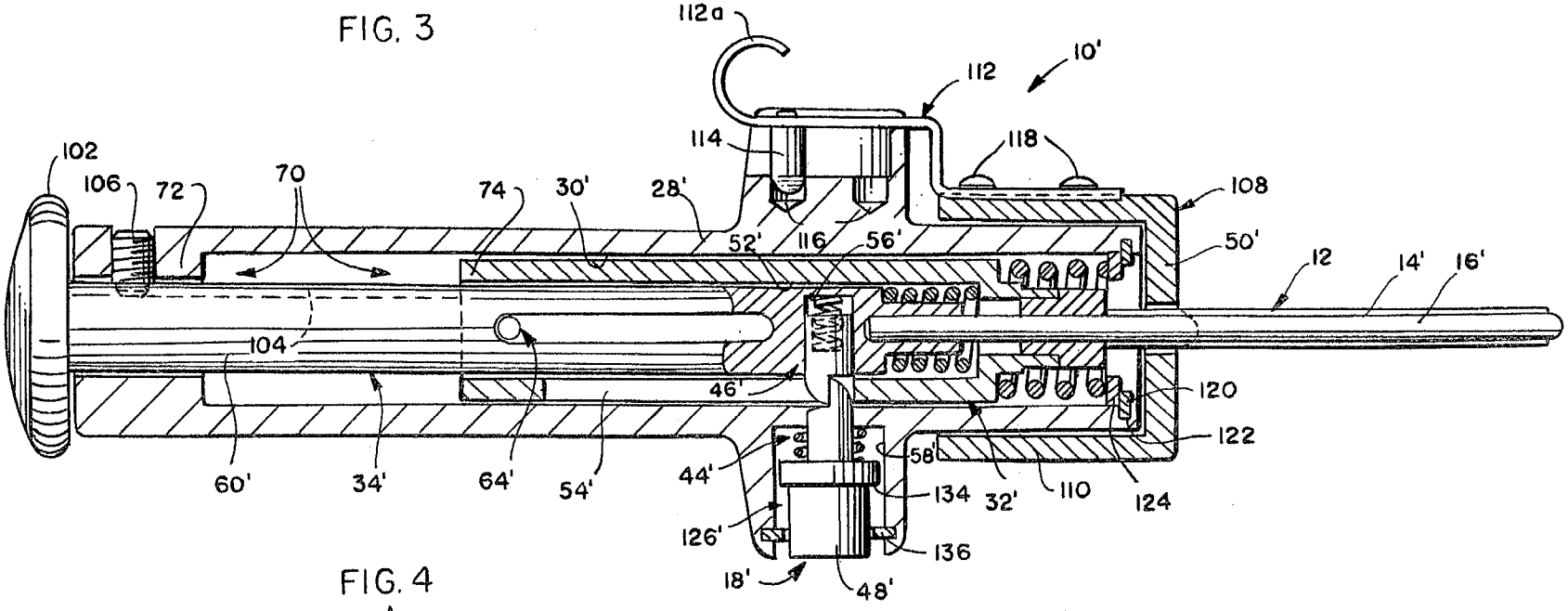
FIG. 3 is a cross-sectional view of an alternative embodiment of a tool for facilitating the insertion of an electrical contact into a contact receiving bore in a resilient electrical connector in accordance with the present invention.

Other features of the present invention (as shown in FIGS. 1 and 2) include the first and second pistons 32 and 34 each having stop means 62 and 64 limiting rearward movement thereof. The stop means 62 associated with the first piston 32 preferably includes an elongated slot 66 in the first piston 32 and a pin or screw 68 internally disposed within the opening or bore 30 in the housing 28 and extending into the slot 66. Referring to FIG. 3, alternative stop means 70 can include an internally disposed shoulder 72 which cooperate with the end 74 of the first piston 32' remote from the sleeve 14'. The stop means 64 associated with the second piston 34 (again as shown in FIGS. 1 and 2) includes an elongated slot 76 through a forward portion 78 thereof mounted for telescopic sliding movement within the opening 52 in the first piston 32 and a pin 80 internally disposed within the first piston 32 and extending through the slot 76. Still other features are the biasing means 26 including a first spring 82 biasing the first piston 32 relative to the housing 28 and a second spring 84 biasing the second piston 34 relative to the first piston 32.

In its most general sense, the present invention is directed to the unitary control mechanism 18 adapted for use with a device such as the tool 10 having a pair of spring biased members slidably mounted therein. The mechanism 18 need only include first and second release means 44 and 46 operatively associated with the spring biased members. The first and second release means 44 and 46 cooperate in a first position to prevent either of the spring biased members from moving within the device and are movable together to a second position permitting one of the spring biased members to slidably move within the device and the first release means 44 is thereafter movable alone back to the first position permitting the other of the spring biased members to slidably move within the device. The mechanism 18 also includes actuating means 48 operatively associated with the first and second release means 44 and 46. With the actuating means 48, the first and second release means 44 and 46 can be moved from the first position to the second position and thereafter the first release means 44 can be moved from the second position back to the first position.

The present invention is therefore directed in its broadest sense to the unitary control mechanism 18 for any device having a pair of spring biased members slidably mounted therein. It is directed more specifically to the unitary control mechanism 18 in a tool 10 for facilitating the insertion of an electrical contact into a contact receiving bore of a resilient electrical connector. This is accomplished by providing structure in which the control means is unitary and preferably bidirectional for two stage movement with movement in a first direction permitting movement of one of a pair of members and movement in a second direction permitting movement of the other of the pair of members. The tool 10 and unitary control mechanism 18 of the present invention fully meet the objective of providing a device which quickly and easily permits the insertion of electrical contacts into the contact receiving bores in a resilient electrical connector without damage to the connector where the device can easily be made hand operated and portable as well. This is also accomplished with structure which is capable of low cost, light weight, but highly effective construction well suited for adaptability to a wide variety of applications. Since the device can easily be made hand operated and portable, it can, for instance, be used in the field to insert electrical contacts into the contact receiving bores in resilient electrical connectors.

Referring again to FIGS. 1 and 2, it will be appreciated that the housing 28 and the pistons 32 and 34 are generally cylindrical in shape. The sleeve 14 and the rod 16 are similarly generally cylindrical in shape as well. The diameter of the main portion 86 of the first piston 32 is generally the same as the diameter of the bore 30 in the housing 28 with the exception of the forward end 88 thereof having a reduced diameter to accommodate the spring 82 between the outer surface thereof and the inner surface of the bore 30. The diameter of the piston extension 60 of the second piston 34 is also generally the same as the diameter of the bore 30 along its entire length. The diameter of the forward portion 78 of the second piston 34 is generally the same as the diameter of the opening 52 in the first piston 32 with the exception of the forward end 90 thereof having a reduced diameter to accommodate the spring 84 between the outer surface thereof and the inner surface of the opening 52. The sleeve 14 and the rod 16 are, of course, also suitably dimensioned to facilitate sliding movement therebetween. With these design parameters, the pistons 32 and 34 are well adapted for relative sequential movement therebetween to facilitate the insertion of electrical contacts into contact receiving bores in resilient electrical connectors.

Of course, the magnitude of movement of the sleeve 14 and the rod 16 from the extended position 20 to the retracted position 22 is controlled by the magnitude of movement of the first piston 32 and the second piston 34. This in turn is controlled by the stop means 62 and the stop means 64 which can easily be altered by readily perceivable design modifications in the length of the pistons 32 and 34, the length of the elongated slots 66 and 76, the placement of the pins 68 and 80, and the length of the sleeve 14 and the rod 16. By varying these design parameters, the relative location of the extended position 20 and the retracted position 22 for the sleeve 14 and the rod 16 can be adapted for any application.

Referring again to FIG. 1, the unitary control means 18 can be better understood. The push button 48 is integral with the first spring detent 44 both of which are disposed in the opening 58. The first spring detent 44 has a smaller diameter than the diameter of the opening 58 to accommodate a spring 92 tending to bias push button 48 toward a protruding position radially outward of the housing 28. The second spring detent 46 has a diameter generally the same as the diameter of the radially extending bore 56 with a spring 94 tending to bias the second spring detent 46 toward the first spring detent 44. The push button 48 is fully capable of controlling movement of the first spring detent 44 and, as a result, the second spring detent 46 due to the cooperation of the notch **46*a* with the projection 44*b* and the notch 44*a* with the projection 46*b*. While it is believed apparent from the foregoing, the spring detents 44 and 46 will automatically move into the cooperatively related position illustrated whenever the radially extending bore 56, the elongated slot 54, and the opening 58** are axially aligned.

After the tool 10 has been cocked or loaded by pushing the piston extension 60 into the housing 28, the sleeve 14 and the rod 16 will be in the extended position 20 and the first and second pistons 32 and 34 will be in the positions shown. The sleeve 14 and the rod 16 can then be inserted into the contact receiving bore 96 of a resilient electrical connector 98 to facilitate insertion of an electrical contact 100. (See FIG. 4.) The push button 48 will be in a protruding position and can thereafter be depressed against the biasing effect of the spring 92 and the spring 94 to cause the first spring detent 44 to move the second sring detent 46 out of the reduced diameter portion **58*a* of the opening 58 into the elongated slot 54. When this has been done, the second piston 34 and, therefore, the rod 16 move rearwardly because of the biasing effect of the spring 84 until the rod 16 reaches the retracted position 22. The push button 48 can then be released which will permit the spring 92 to bias the push button 48 back into the protruding position in which the first spring detent 44 is fully disposed within the opening 58. After this has been done, the first piston 32, and, therefore, the sleeve 14 move rearwardly because of the biasing effect of the spring 82 until the sleeve 14 reaches the retracted position 22. The push button 48 alone controls the movement of the sleeve 14 and the rod 16 with the stops 62 and 64 defining the limits of rearward movement for both the sleeve 14 and the rod 16** as previously described.

When it is later desired to again use the tool 10, the piston extension 60 can again be moved forward relative to the bore 30 in the housing 28 until the radially extending bore 56 in the second piston 34, the elongated slot 54 in the first piston 32 and the opening 58 in the housing 28 are all axially aligned at which point the first and second spring detents 44 and 46 will matingly engage once again to secure the sleeve 14 and the rod 16 in the extended position 20 for further use.

Referring to FIG. 3, an alternative form of tool 10' is illustrated. The tool 10' is identical in most respects to the tool 10; namely, it includes bore enlarging means 12' having a sleeve 14' and a rod 16', unitary control means 18' including a first spring detent 44' and a second spring detent 46' (again depicted in an intermediate position), a housing 28' including a bore 30' extending therethrough and terminating in an apertured front wall 50', first and second pistons 32' and 34', external actuation means or push button 48' (again depicted in an intermediate position), an opening 52' in the first piston 32', an elongated slot 54' in the first piston 32', a radially extending bore 56' in the second piston 34', an opening 58' in the housing 28', and stop means 64' associated with the second piston 34'. While there are minor variations in construction of some of these features which will be readily apparent to those skilled in the art, the features outlined correspond to and function identically as the features outlined in FIG. 1.

However, one of the primary differences between the embodiment of FIG. 1 and the embodiment of FIG. 3 lies in the stop means associated with the first piston 32 or 32'. The stop means 62 associated with the piston 32 in FIG. 1 comprises an elongated slot 66 and a pin or screw 68. The stop means 70 associated with the first piston 32' in FIG. 3 comprises an internally disposed shoulder 72 within the housing 28' which cooperates with the end 74 of the first piston 32'. Additionally, the piston extension 60' associated with the second piston 34' includes a handle 102 for moving the first and second pistons 32' and 34' such that the second spring detent 46' can be disposed in the opening 58' in axially aligned mating engagement with the first spring detent 44' after the unitary control means 18' has been used to sequentially move the sleeve 14' and the rod 16' from the extended position 20' to the retracted position 22'.

Still other important features of the alternative form of tool 10' illustrated in FIG. 3 include an elongated groove 104 extending longitudinally of the second piston 34' along the outer surface thereof. A stud 106 extends radially within the bore 30' at a point rearward of the shoulder 72 to cooperate with the elongated groove 104. It will be apparent that the stud 106 and the elongated groove 104 prevent rotational movement of the second piston 34' as it moves within the housing 28'. An adjustable nose cap 108 is also provided to accommodate the differences in size between male connectors and female connectors. As will be appreciated by those skilled in the art, the male connector may be smaller than the female connector, for instance, so adjustability of the tool 10' to accommodate both types provides greater versatility for the tool 10' by eliminating the need for two separate tools.

Referring to FIG. 3 in greater detail, the adjustable nose cap 108 includes a generally cylindrical member 110 terminating in the apertured front wall 50'. It also includes a spring 112 biasing a detent 114 into one of a pair of longitudinally spaced bores 116. The spring 112 is secured to the adjustable nose cap 108 with fasteners 118 which may be screws, rivets, or any other conventional type of fastening means. It also includes a partial loop portion 112*a* which may be used to lift the detent 114 from the bore 116 when it is desired to move the detent to the other bore 116. Of course, this adjusts the nose cap 108 either forwardly or rearwardly to accommodate either male or female connectors.

As shown, the spring 82' associated with the first piston 32' is maintained in the housing in proper position for biasing the first piston 32' by a snap ring 120 disposed in a circumferential groove 122 and a washer 124 which is positioned between the snap ring 120 and the spring 82'. This is necessary since the bore 30' is made from the front of the tool 10' to form the shoulder 72 in this embodiment and also since the nose cap 108 is adjustable. Without internal retention means such as the snap ring 120 and washer 124, the adjustable nose cap 108 would not be feasible because the inner surface of the apertured front wall 50' thereof would have to serve as the support for the spring 82' against which it would react to bias the first piston 32' rearwardly.

Other features of the tools 10 and 10' include stop means 126 and 126', respectively, limiting outward movement of the push buttons 48 and 48'. The stop means 126 (as shown) in FIG. 1) includes a pin 128 which extends through an aperture 130 in the housing 28 and through a slotted opening 132 in the push button 48. It will be appreciated that the length of the slotted opening 132 will define the limits of movement of the push button 48. The stop means 126' (as shown in FIG. 3) includes a circumferential enlargement 134 on the push button 48' which cooperates with a shoulder 136 extending radially inwardly into the opening 58'. Both forms of stop means 126 and 126' are well suited for limiting outward movement of the push buttons 48 and 48' and either form can be used with either of the tools 10 or 10' as desired.

With either of the tools 10 or 10', the piston moving means 60 or 60' can include pneumatic loading means (not shown). This will simply take the form of an air cylinder mounted on the rear of the tool 10 or 10' to drive the second piston 34 or 34' and, therefore, the first piston 32 or 32' forward within the bore 30 or 30' in the housing 28 or 28' until the unitary control means 18 or 18' is again cocked. By way of example, the pneumatic loading means can suitably be controlled by means of a second push button (not shown).

Figure 4:
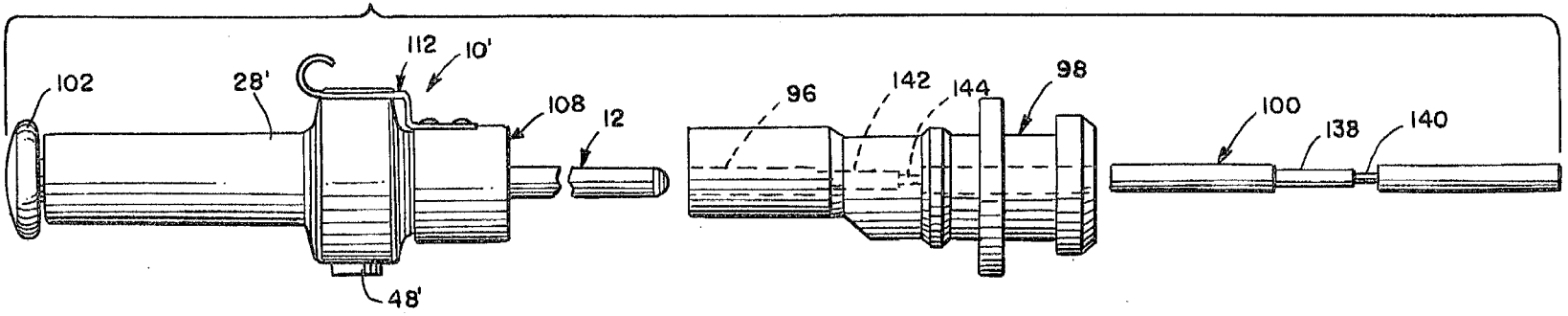
FIG. 4 is a front elevational view of the tool of FIG. 3 illustrating the manner of use with an electrical contact and resilient electrical connector.

Referring to FIG. 4, the features of hand operated and portable use of the tool 10' with a resilient electrical connector 98 can readily be understood. The sleeve 14' and the rod 16' are inserted in the extended position 20' completely through the contact receiving bore 96. This can be done by using one hand to hold the tool 10' and the other hand to hold the connector 98 in a manner which will not cause damage to internal diameter restrictions 104 and 106 while at the same time enlarging the bore 96 sufficiently to receive the electrical contact 100. The rod 16' can then be moved from the extended position 20' to the retracted position 22' by using the thumb of the hand holding the tool 10' to depress the push button 48' which is sufficient to permit insertion of the contact 100 with the other hand with zero insertion force into the bore 96 within the sleeve 14'. After this has been done, the sleeve 14' can be moved from the extended position 20' to the retracted position 22' by using the thumb of the hand holding the tool 10' to release the push button 48' which withdraws the sleeve 14' from the bore 96 but leaves the electrical contact 100 in proper position within the resilient electrical connector 98.

As will be appreciated, the rod 16' in the retracted position 22' actually serves as a depth stop for the electrical contact 100 as it is being inserted into the resilient electrical connector 98. This makes it possible to exactly position the cut away portions 138 and 140 of the electrical contact 100 in alignment with the corresponding internal diameter restrictions 142 and 144 in the contact receiving bore 96. Moreover, the retracted position 22' of the sleeve 14' and the rod 16' can be set such that movement of the sleeve 14' to the retracted position 22' withdraws it from the resilient electrical connector 98 using the design techniques discussed in detail above. While the insertion of the electrical contact 100 into the contact receiving bore 96 of the resilient electrical contact 98 has been discussed in connection with the tool 10', it will readily be appreciated that the tool 10 is used in identical fashion.

The present invention therefore achieves the objective of providing in the broadest sense a unitary control mechanism for a device having a pair of spring biased members slidably mounted therein. It more specifically accomplishes the objective of providing a tool for facilitating the insertion of an electrical contact into a contact receiving bore of a resilient electrical connector. This is accomplished by providing structure in which the control means is unitary and preferably bidirectional providing two stage operation with movement in a first direction permitting movement of one of a pair of members and movement in a second direction permitting movement of the other of the pair of members. The tool and unitary control mechanism of the present invention meets the objective of providing a device which quickly and easily permits the insertion of electrical contacts into the contact receiving bores in a resilient electrical connector with zero insertion force without damage to the connector where the device can easily be hand operated and portable. This is also accomplished with structure which is capable of low cost, light weight, but highly effective construction well suited for adaptability to a wide variety of applications including adaptability of the same features of pneumatic and other types of tools as well.

While in the foregoing specification, a detailed description of the invention has been set forth for purposes of illustration, the details herein given may be varied by those skilled in the art without departing from the spirit and scope of the invention as defined by the appended claims.

I claim:

1. A tool for facilitating the insertion of an electrical contact into a contact receiving bore of a resilient connector, comprising:

a housing having a bore extending therethrough, said bore terminating at a forward end in an apertured front wall;

first and second pistons slidably mounted within said bore, said first piston having an opening extending therethrough and being positioned forwardly of said second piston, said second piston being mounted for independent sliding movement relative to said first piston;

means biasing said first piston and said second piston rearwardly within said bore in said housing;

a sleeve for insertion into said bore of said connector for enlargement thereof, said sleeve having a first end secured to said first piston and having a second end extending through said apertured front wall of said housing to a point beyond said housing, said sleeve moving in response to sliding movement of said first piston between a first position in which said second end thereof is remote from said housing and a second position in which said second end thereof is near said housing;

a rod having a first end secured to said second piston and having a second end extending through said opening in said first piston and said apertured front wall of said housing to a point beyond said housing, said rod being coaxially aligned within said sleeve for insertion into said bore of said connector in conjunction with said sleeve, said rod moving in response to sliding movement of said second piston between a first position in which said second end thereof is remote from said housing and a second position in which said second end thereof is near said housing; and unitary means operatively associated with said first and second pistons for controlling the relative sequential movement between said first and second pistons and between said sleeve and said rod after said sleeve and said rod have been inserted into said bore of said connector for enlargement thereof;

said unitary control means including spring release means, said spring release means in a first position resisting rearward movement of said first and second pistons, said unitary control means including means for moving said spring release means to a second position permitting rearward movement of said second piston but resisting rearward movement of said first piston, and said unitary control means including means for returning said spring release means to said first position permitting rearward movement of said first piston.

2. The tool as defined in claim 1 in which said first position of said sleeve and said rod is an extended position and said second position of said sleeve and said rod is a retracted position.

3. The tool as defined in claim 2 in which said spring release means includes first and second spring detents for temporarily locking said first and second pistons such that said sleeve and said rod are secured in said extended position.

4. The tool as defined in claim 3 in which said first and second spring detents are cooperatively associated with said first and second pistons and with actuation means external of said housing for moving said first and second spring detents between said first position and said second position.

5. The tool as defined in claim 4 in which said second spring detent releases said second piston when said external actuation means is utilized to move said first and second spring detents from said first position to said second position.

6. The tool as defined in claim 5 in which said first spring detent thereafter releases said first piston when said external actuation means is utilized to permit said first spring detent to move from said second position back to said first position.

7. The tool as defined in clain 5 in which said biasing means moves said second piston such that said rod moves from said extended position to said retracted position when said second spring detent releases said second piston.

8. The tool as defined in claim 6 in which said biasing means moves said first piston such that said sleeve moves from said extended position to said retracted position when said first spring detent releases said first piston.

9. The tool as defined in claim 4 in which said external actuation means is integral with said first spring detent and said second spring detent is integral with one of said pistons.

10. The tool as defined in claim 9 in which said first spring detent includes means for engaging said second spring detent in axially aligned mating engagement in said first position.

11. The tool as defined in claim 10 in which said first piston includes an elongated slot and said second piston includes a radial bore in communication with said elongated slot.

12. The tool as defined in claim 11 in which said housing includes an opening with means for axially aligning said elongated slot and said radial bore.

13. The tool as defined in claim 12 in which said external actuation means and said first spring detent are disposed in said opening and said first spring detent is extensible into said elongated slot and said second spring detent is disposed in said radial bore and said elongated slot and said second spring detent is extensible into said opening.

14. The tool as defined in claim 13 in which said first and second spring detents each include a projection and a notch, said projection of said first spring detent fitting into said notch of said second spring detent and said projection of said second spring detent fitting into said notch of said first spring detent when said first and second spring detents are in axially aligned mating engagement.

15. The tool as defined in claim 14 in which said second spring detent resists rearward movement of said first and second pistons when said second spring detent extends into said openings in said housing in axially aligned mating engagement with said first spring detent.

16. The tool as defined in claim 15 in which said second spring detent then permits rearward movement of said second piston upon being moved into said elongated slot and said first spring detent resists rearward movement of said first piston upon being moved into said elongated slot.

17. The tool as defined in claim 16 in which said first spring detent thereafter permits rearward movement of said first piston upon being moved back into said opening in said housing.

18. The tool as defined in claim 17 in which said external actuation means includes means for moving said first and second spring detents from said opening in said housing into said elongated slot and thereafter permits said first spring detent to move from said elongated slot back into said housing.

19. The tool as defined in claim 17 including means external of said housing for moving said first and second pistons such that said second spring detent is again disposed in said opening in axially aligned mating engagement with said first spring detent.

20. The tool as defined in claim 19 in which said piston moving means is a piston extension associated with said second piston which may be moved forward causing said first and second pistons to move such that said sleeve and said rod are moved from said retracted position to said extended position.

21. The tool as defined in claim 1 in which said first and second pistons each include stop means limiting rearward movement thereof.

22. The tool as defined in claim 21 in which said stop means associated with said first piston includes an elongated slot in said first piston and a pin internally disposed within said housing and extending into said slot.

23. The tool as defined in claim 21 in which said stop means associated with said first piston includes an internally disposed shoulder within said housing cooperating with the end of said first piston remote from said sleeve.

24. The tool as defined in claim 22 in which said second piston includes a forward portion mounted for telescopic sliding movement within said opening in said first piston.

25. The tool as defined in claim 24 in which said stop means associated with said second piston includes an elongated slot through said forward portion of said second piston and a pin internally disposed within said first piston and extending through said slot.

26. The tool as defined in claim 1 in which said biasing means includes a first spring biasing said first piston relative to said housing and a second spring biasing said second piston relative to said first piston.

27. The tool as defined in claim 4 in which said external actuation means is a push button.

28. The tool as defined in claim 1 in which said housing includes an adjustable nose cap associated with said forward end thereof, said adjustable nose cap terminating in said apertured front wall, said adjustable nose cap permitting use of said tool with resilient connectors of differing size.

29. A tool for facilitating the insertion of an electrical contact into a contact receiving bore of a resilient electrical connector, comprising:

a housing having an opening extending therethrough;

first and second pistons slidably mounted within said opening;

bore insertion means including sleeve means slidably movable between first and second positions and rod means coaxially aligned within said sleeve means for slidably moving between first and second positions, said first positions of said sleeve and said rod constituting extended positions;

said sleeve means being secured to said first piston for movement therewith and said rod means being secured to said second piston for movement therewith;

means operatively associated with said first and second pistons for controlling the movement of said sleeve means and said rod means;

said control means controlling movement of said rod means between said first position and said second position followed by movement of said sleeve means between said first position and said second position, said control means including means for temporarily securing said rod and said sleeve in said extended positions, said securing means including spring detent means cooperating with said first and second pistons and actuation means for moving said spring detent means to release said pistons.

30. The tool as defined in claim 29 including means biasing said first and second pistons such that said sleeve and said rod are biased toward said second position when said first and second pistons are temporarily secured with said spring detent means.

31. The tool as defined in claim 30 in which said spring detent means is movable by said activation means between a first position and a second position and wherein said spring detent means releases said second piston when said actuation means is moved from said first position to said second position and thereafter releases said first piston when said actuation means is moved from said second position back to said first position.

32. The tool as defined in claim 31 in which said biasing means moves said second piston such that said rod moves from said extended position to said second position when said spring detent means releases said second piston.

33. The tool as defined in claim 32 in which said biasing means moves said first piston such that said sleeve moves from said extended position to said second position when said spring detent means releases said first piston.

34. The tool as defined in claim 33 wherein said second position is a retracted position and including means external of said housing for moving said first and second pistons such that said sleeve and said rod move from said retracted position to said extended position where said spring detent means temporarily secures said first and second pistons.

35. A tool for facilitating the insertion of an electrical contact into a resilient contact receiving bore of an electrical connector, comprising:

bore insertion means including sleeve means slidably movable between first and second positions and rod means coaxially aligned within said sleeve means for slidably moving between first and second positions, said first positions of said sleeve means and said rod means constituting extended positions;

unitary control means for regulating the movement of said sleeve means and said rod means;

said control means controlling movement of said rod means between said first position and said second position followed by movement of said sleeve means between said first position and said second position;

said control means including means for temporarily securing said rod and said sleeve in said extended positions, said securing means including spring detent means cooperating with said rod means and said sleeve means and actuation means for moving said spring detent means to release said rod means and said sleeve means.

36. The tool as defined in claim 35 in which said unitary control means includes means for temporarily locking said sleeve and said rod in said extended position.

37. The tool as defined in claim 36 in which said second position is a retracted position and including means biasing said sleeve and said rod toward said retracted position when said sleeve and said rod are temporarily locked in said extended position.

38. A hand tool for facilitating the insertion of an electrical contact into a contact receiving bore of an electrical connector, comprising:

a housing having an opening extending therethrough, said housing being sized and shaped to be held in the hand of a user;

first and second pistons slidably mounted within said opening;

bore insertion means including sleeve means slidably movable between first and second positions and rod means coaxially aligned within said sleeve means for slidably moving between first and second positions, said first positions of said sleeve and said rod constituting extended positions;

said sleeve means being secured to said first piston for movement therewith and said rod means being secured to said second piston for movement therewith;

means operatively associated with said first and second pistons for controlling the movement of said sleeve means and said rod means, said control means being positioned within said housing for hand operation from a point external to said housing;

said control means controlling movement of said rod means between said first position and said second position followed by movement of said sleeve means between said first position and said second position, said control means including means for temporarily securing said rod and said sleeve in said extended positions, said securing means including spring detent means cooperating with said first and second pistons and actuation means for moving said spring detent means to release said pistons.

* * * * *